United States Patent [19]

Höfer et al.

[11] Patent Number: 4,630,587

[45] Date of Patent: Dec. 23, 1986

[54] FUEL INJECTION PUMP HAVING AN ADJUSTABLE INSTANT OF INJECTION

[75] Inventors: Gerald Höfer, Weissach-Flacht; Eberhard Hofmann, Kirchberg/Murr; Helmut Laufer, Stuttgart, all of Fed. Rep. of Germany; Francois Rossignol, Mornant, France; Reinhard Schwartz; Max Straubel, both of Stuttgart, Fed. Rep. of Germany; Raymond Tissot, Genas, France

[73] Assignee: Robert Bosch GmbH, Stuttgart, Fed. Rep. of Germany

[21] Appl. No.: 432,600

[22] Filed: Oct. 4, 1982

[30] Foreign Application Priority Data

Oct. 30, 1981 [DE] Fed. Rep. of Germany ..... 3143073

[51] Int. Cl.[4] ..... F02M 39/00; F02M 59/28

[52] U.S. Cl. ..... 123/502; 123/467; 417/294; 239/93

[58] Field of Search ..... 123/502, 501, 500, 467; 417/294, 304, 494; 239/88–95, 533.2–533.12

[56] References Cited

U.S. PATENT DOCUMENTS

| | | | |
|---|---|---|---|
| 2,147,390 | 2/1939 | Vaudet | 123/500 |
| 2,279,010 | 4/1942 | Nichols | 123/467 |
| 2,569,233 | 9/1951 | Dickson | 123/502 |
| 4,249,499 | 2/1981 | Perr | 123/502 |
| 4,399,793 | 8/1983 | Poore | 123/502 |
| 4,419,977 | 12/1983 | Hillebrand | 123/502 |

FOREIGN PATENT DOCUMENTS

| | | | |
|---|---|---|---|
| 2076074 | 11/1981 | United Kingdom | 123/501 |

*Primary Examiner*—Carl Stuart Miller

*Attorney, Agent, or Firm*—Edwin E. Greigg

[57] ABSTRACT

The injection pump includes a pump cylinder, a pump piston moving into it and a hydraulic device for adjusting the instant of injection. The adjusting device has an adjusting cylinder, which is directed parallel to the pump cylinder and is accommodated in the housing of the injection pump, and adjusting piston and a restoring spring and adjusts a control sleeve, which opens the pump piston provided with at least one control recess in the longitudinal direction of the pump piston. This orientation and disposition of the adjusting cylinder effects a space-saving and inexpensive design of the injection pump and improves the precision of adjustment. The adjusting piston and the control sleeve may be directed coaxially and embodied as a single component, as a result of which a further space saving and increase in adjustment precision are attained.

8 Claims, 5 Drawing Figures

FUEL INJECTION PUMP HAVING AN ADJUSTABLE INSTANT OF INJECTION

BACKGROUND OF THE INVENTION

The invention is based on a fuel injection pump for Diesel engines having a pump cylinder, a pump piston in the cylinder, and the pump piston being provided with at least one control recess. The pump piston is adapted to be reciprocated by a cam means and a cooperating spring means, with a control means arranged to encircle the pump piston and with the control means associated with a hydraulic adjusting means. The control means is arranged to cooperate with the control recess for varying the injection quantity and thereby the instant of injection. An injection pump having a pump cylinder, a pump piston dipping into this pump cylinder, and a hydraulic adjusting device for the instant of injection is known from U.S. Pat. No. 2,313,264. The adjusting device has an elastic bellows inside a chamber, the closed end of the bellows being movable, a spring which expands the bellows, a rack connected with the end of the bellows, a gear wheel meshing with this rack having an internal thread, and a stop sheath secured against rotation, the outer thread of which is threaded into the gear wheel. The stop sheath has a collar which determines the outset position of the pump piston. The pump piston is lifted toward this collar by means of a spring. An adjusting mechanism having a rack and a gear wheel is conventional, but expensive. In order to attain high adjustment precision, the rack, the gear wheel and the stop sheath must be supported with as little play as possible and must mesh with one another without play. This makes the manufacture of such elements expensive. A further disadvantage of this injection pump is that its pump piston is driven by a control cam via a hydraulic push rod which compensates for play. In addition, a further pump must also be provided which supplies the push rod with pressure fluid in the form of oil.

In an injection pump known from the unexamined Japanese patent application No. 131562/80 or proposed in the British application No. 2076074A, made public in the interval since the priority date, the instant of injection is fixed by means of adjusting the height or level of a control sleeve, which sealingly surrounds the pump piston, which moves vertically up and down with a constant stroke height, and has at least one control recess directed toward the pump piston, the recess being overtaken by a control opening disposed in the pump piston. The control sleeve is lifted or lowered via an adjusting shaft, the pivoting shaft of which is directed transversely relative to the longitudinal axis of the pump piston, and via an adjusting tang which is inserted into one end of the adjusting shaft and engages the control sleeve. The adjusting shaft protrudes out of the housing of the injection pump and carries an adjusting lever. The adjusting levers for a plurality of sleeves may be pivoted in common via tangs, for instance by means of a sliding rod. Injection pumps known from British Pat. No. 442,475 and European Pat. No. EP-A1-0027790 also have control sleeves which surround the pump pistons and are adjustable in their stroke directions. The adjustment is again effected by means of pivotable shafts which are carried outside the housing of the pump. The expensive hydraulic injection pump system according to U.S. Pat. No. 2,313,264 avoids the disadvantages of the mechanical adjustment of control sleeves in common with one another. Accordingly, the object of creating an improved and less expensive injection pump having a hydraulic adjustment of the instant of injection presented itself.

OBJECT AND SUMMARY OF THE INVENTION

The injection pump has the advantages that the hydraulic adjusting forces are generated parallel to the adjusting direction of the control sleeve and can thus be transmitted to the control sleeve without complicated transmission elements. The pump is therefore less expensive, requires less space and functions more precisely. A hydraulic push rod for driving the pump piston is not required.

Further embodying the pump as set forth herein makes it possible to further reduce the injection pump in size and to increase the precision of adjustment, because the adjusting piston is disposed closer to the control sleeve. Control means set forth enables a further reduction in size as well as cost of the injection pump. Embodying the injection pump with a one piece structural component still further reduces the size of the injection pump and improves its adjustability and the adjustment of the instant of injection can be performed independently of the adjustment of the injection quantity. The two kinds of adjustments do not interfere with one another. Fuel delivered to the injection pump is utilized as a hydraulic pressure medium, so that fewer tubular lines are required and it is less expensive to install the pump. Delivery of fuel effects good cooling of the injection pump because it is well flushed with fuel. Gas bubbles which may arise in the pump cylinder or at the pump piston are also flushed away thereby. As a result, the injection pump functions with greater precision of fuel metering. Control of discharged fuel has the effect that a pressure wave which begins at a control opening of a pump piston upon the end of one injection supply stroke is carried to the side toward the spring of an injection nozzle closing piston, and as a result accelerates the closing piston in its movement into the closing position, reinforcing the force of a nozzle closing spring. This has the advantage that the injection nozzle is rapidly closed, and less fuel is capable of slowly escaping as a result. This advantage is particularly clearly pronounced, because the brief removal of the injection nozzle from the injection pump means that the pressure wave arrives at the injection nozzle closing piston rapidly and substantially in an undamped manner.

Further embodying an injection pump as set forth provides a safety means preventing the starting of an engine in the event that it may be unintentionally turned off by a vehicle in which the engine has been installed. In an injection pump having hydraulic adjustment of the instant of injection, the safety means is switched on by the reduction of the adjusting pressure. Means provided serves to reduce the adjusting pressure and simultaneously prevents the injection pump from emptying in an undesirable manner following this pressure reduction. However, this can also be attained in injection pumps having a different structure from those set forth herein.

The invention will be better understood and further objects and advantages thereof will become more apparent from the ensuing detailed description of the three preferred embodiments taken in conjunction with the drawings.

DESCRIPTION OF THE EXEMPLARY EMBODIMENTS

Figure 1:
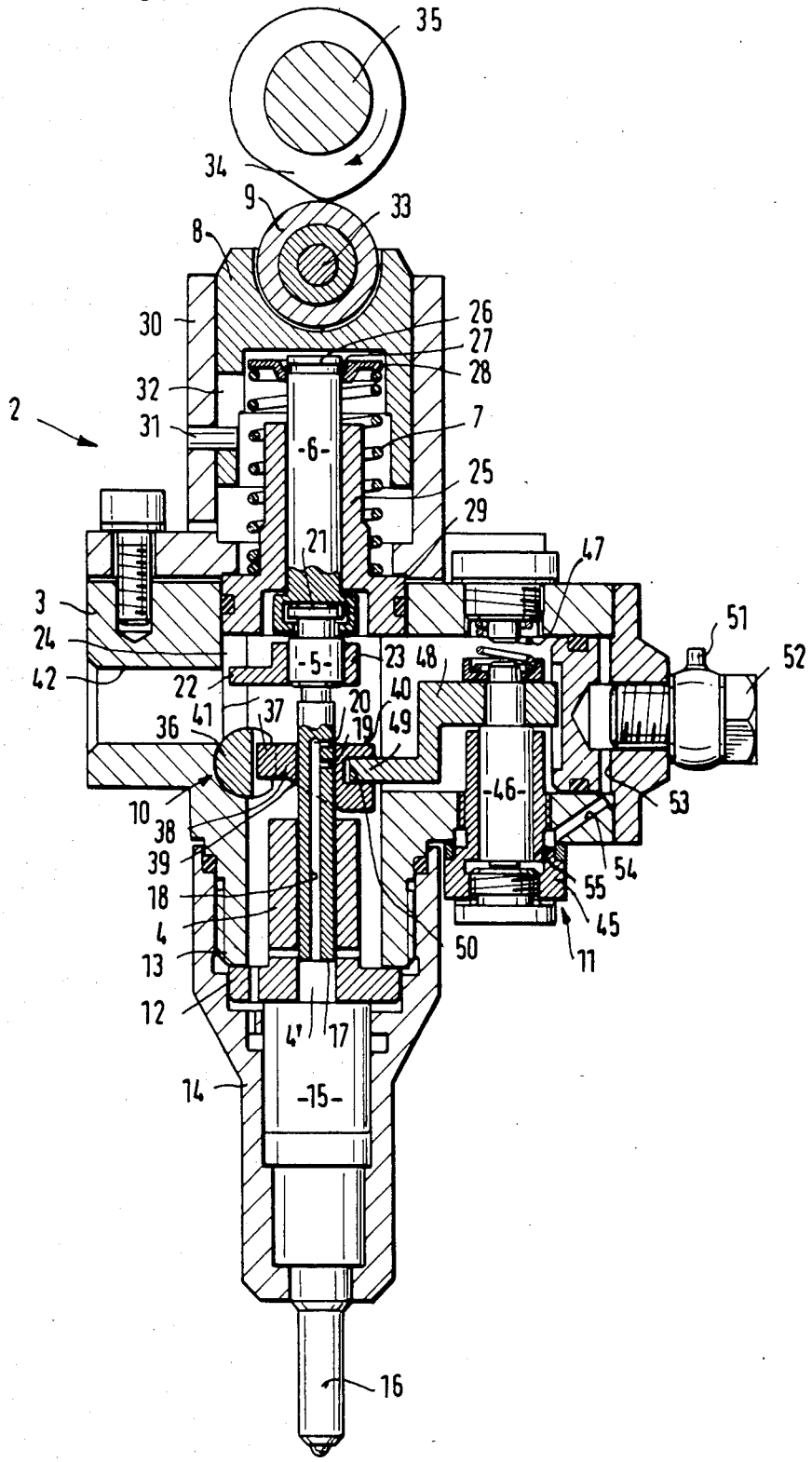
FIG. 1 shows the first exemplary embodiment of the injection pump according to the invention, seen in a cross section taken along the axis of its pump piston.

The injection pump 2 of FIG. 1 has a housing 3, a pump cylinder 4, a pump piston 5, a drive rod 6 for the pump piston 5, a restoring spring 7, a drive push rod 8, a roller 9, an injection quantity adjusting device 10 and an adjusting device 11 for the instant of injection.

The pump cylinder 4 is tubular in embodiment and has a fastening flange 12, which rests against the lower end 13 of the housing 3 and is held in place by means of a sheath 14, which is threaded to the lower end 13. At the bottom, a pressure valve 15 (not shown in further detail) adjoins the pump cylinder 4, and an injection nozzle 16 adjoins the pressure valve 15. The sheath 14 clamps the injection nozzle 16 in turn and the pressure valve 15 against the fastening flange of the pump cylinder 4.

The pump piston 5 has a longitudinal bore 18 beginning at its end 17 which extends down into the pump cylinder 4. The pump piston 5 has two transverse bores 19, 20, which are spaced apart from one another in the axial direction of the pump piston 5. The upper end 21 of the pump piston 5 is coupled with the drive rod 6. Below the guide rod 6, a guide arm 22 which has an eye 23 is movable along a guide groove 24, which is disposed parallel to the direction of movement of the pump piston 5 within the housing 3. The eye 23 is pressed onto the pump piston 5 and via the guide arm 22 and the guide groove 24 secures the pump piston against twisting. The drive rod 6 is guided within a guide sheath 25 inserted into the housing 3. At one end 26 of the drive rod 6 remote from the pump piston 5, a spring plate 28 is secured by means of a wire ring 27. The restoring spring 7 presses against the spring plate 28 such that the pump piston 5 is drawn upwardly in the pump cylinder 4. The restoring spring 7, which surrounds the guide sheath 25 is supported on a collar 29 which is molded onto this guide sheath 25. The drive push rod 8 is substantially cup-shaped in embodiment and as shown is moved coaxially with the drive rod 6. It is guided by means of a push rod guide 30, which is screwed to the housing 3. A guide pin 31 which is pressed into the push rod guide 30 in the radial direction engages a guide groove 32 that is cut into the drive push rod 8 parallel to its longitudinal axis and thereby secures this drive push rod 8 against twisting. The roller 9 is rotatably supported on the drive push rod 8 by means of a bolt or pin 33. A drive cam 34 which is turned by a drive shaft 35 is disposed above the roller 9. The drive cam 34 presses the drive push rod 8 against the end 26 of the drive rod 6, pushes the rod 6 in the direction of the pump cylinder 4 and thereby clamps the restoring spring 7. Once the uppermost point of the cam 34 has traveled past the roller 9, the restoring spring 7 lifts the drive rod 6 and thus pulls the pump piston upward.

The injection quantity adjusting device 10 has a rack 36 intersecting the longitudinal axis of the pump piston 5 at some distance and a control sleeve 38 provided with teeth 37. The control sleeve 38 surrounds the pump piston 5 and is rotatable relative to the pump piston by means of the rack 36. The rack 36 may be actuated in a conventional manner by an rpm governor or a foot pedal or a hand lever. On the side toward the pump cylinder 4, the control sleeve 38 has an inclined control edge 39 and on the opposite side a control edge 40 which extends transversely relative to the pump piston 5. In the upper portion of the downward stroke of the pump piston 5, the control sleeve 38 closes off the transverse bore 19. As the pump piston is lowered, the transverse bore 20 is caused to coincide with the control sleeve 38, and the control edge 40 thereof closes the cross section of the transverse bore 20, as a result of which fuel located in the pump cylinder is placed under pressure. As the pump piston 5 continues to drop, the transverse bore 19 is opened at it travels past the oblique control edge 39. The opening of this transverse bore 19 causes the interior 4' of the pump cylinder 4 to communicate, via the longitudinal bore 18 and the transverse bore 19, with an interior chamber 41 of the housing 3. Fuel pumped via a supply opening 42 into the interior chamber 41 of the housing 3, which has been aspirated into the pump cylinder 4 during an upward stroke of the pump piston 5 and is placed under pressure after the transverse bore 20 has been closed, is then no longer pumped to the injection nozzle 16 through the pressure valve 15, but instead escapes back into the interior chamber 41. Depending on the rotary position of the control sleeve 38, the pump piston 5, beginning at a closed position at which the transverse bore 20 travels past the control edge 40, travels a more or less long distance back until it once again reaches the control edge 39. This distance, multiplied by the cross sectional area of the pump piston 5, produces approximately that fuel quantity which is pumped to the injection nozzle 16.

The adjusting device 11 for the instant of injection has an adjusting cylinder 45 directed parallel to the pump piston 5 and screwed into the housing 3, an adjusting piston 46, a restoring spring 47 and an adjusting arm 48. The adjusting arm 48 is connected firmly to the adjusting piston 46 and has an adjusting end 49. The adjusting end 49 engages a groove-like recess 50 in the control sleeve 38, with said recess being defined by planes located transversely with respect to the longitudinal axis of the pump piston 5. The restoring spring 47 is disposed above the adjusting arm 48 and presses the adjusting piston 46 and the control sleeve 38 downward via the adjusting arm 48, in other words pressing the control sleeve 38 toward the pump cylinder 4. The adjusting piston 46 is located below the adjusting arm 48 and is exposed to a pressure fluid which is delivered via a line 51, a hollow connection screw 52, and conduits 53, 54 and 55 to the adjusting cylinder 45. Depending upon the magnitude of a pressure exerted upon the adjusting piston 46, the adjusting arm 48 is raised to a greater or lesser extent counter to the force of the spring 47. If the adjusting arm 48 and thus the control sleeve as well as in the lowermost position, then the pump piston 5, beginning at its uppermost location, must travel a long distance until its transverse bore 20 is closed by the control sleeve 38. In this position of the control sleeve 38, the buildup of injection pressure in the pump cylinder 4 takes place relatively late in terms of the beginning of the downward stroke of the pump piston 5. If the control sleeve 38 is raised by the influence of the adjusting piston 46, then the pressure buildup and thus the onset of injection occur earlier. The pressure for adjusting the instant of injection toward "early" may be generated, for example, by means of pumping and regulating devices as described in U.S. Pat. No. 2,313,264.

Figure 2:
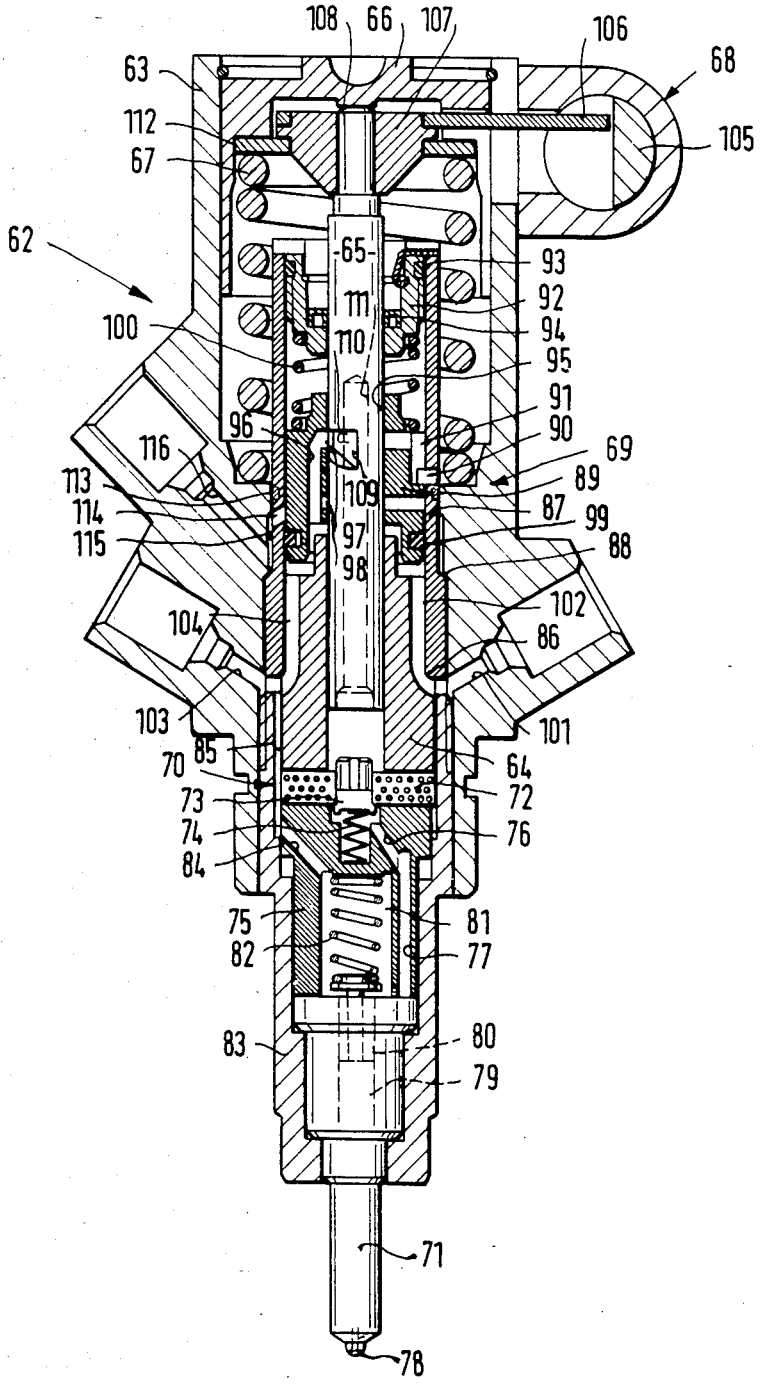
FIG. 2 shows the second exemplary embodiment, again in cross section.

The injection pump 62 shown in FIG. 2 has a housing 63, a pump cylinder 64, a pump piston 65, a drive push rod 66, a restoring spring 67, an injection quantity adjusting device 68, and an adjusting device 69 for the instant of injection.

A pressure valve 70 is disposed below the pump cylinder 64, and an injection nozzle 71 is disposed below the pressure valve 70. The pressure valve 70 comprises a perforated disk 72 resting on the pump cylinder 64 and forming a valve seat, a valve body 73 movable relative to this disk 72, and a spring 74, which presses the valve body 73 in the direction of the pump cylinder 64 against the valve seat. The spring 74 is supported in a structural component 75 resting against the perforated disk 72. The structural component 75 includes two interconnected conduits 76, 77, which begin at the pressure valve 70 and lead to the injection nozzle 71. They serve to direct fuel which is to be injected into a pressure chamber, not shown, which leads to nozzle ports 78. Above this pressure chamber, an injection nozzle closing piston 79 is displaceably supported in a cylinder 80. The injection nozzle closing piston 79 has a nozzle neddle, not shown, which closes the nozzle ports 78 under the influence of a nozzle closing spring 82 and is subjected to fuel flowing around the nozzle needle from the pressure chamber. In the direction of the pump cylinder 64, a chamber 81 adjoins the cylinder 80. The nozzle closing spring 82 is accommodated inside the chamber 81. The injection nozzle 71, the component 75, the valve seat 72, and the pump cylinder 64 are held together by a sheath 83 screwed into the housing 69. A conduit 84 which connects the chamber 81 with a conduit 85 extending up to the upper end of the sheath 83 is located in the component 75.

The pump cylinder 64 has a shoulder 86 at its circumference. This shoulder 86 presses against a coaxially directed adjusting cylinder 87, which is inserted from below into the pump housing 53 as far as a shoulder 88. The adjusting cylinder 87 is a component of the adjusting device 69 for the instant of injection. An adjusting pistion 89 of the adjusting device 69 for the instant of injection is disposed in an axially displaceable manner in the adjusting cylinder 87 and is secured against twisting. The adjusting piston 89 is secured against twisting by means of a guide pin 90, which protrudes radially into the adjusting cylinder 87 and dips into a guide groove 91. The guide groove 91 is cut into the adjusting piston 89 parallel to its longitudinal axis. A hollow closure plug 92 is threaded into the upper end of the adjusting cylinder 87. The pump piston 65 extends all the way through this closure plug 92. The closure plug 92 is sealed off relative to the adjusting cylinder 87 by means of a sealing ring 93 and relative to the pump piston 65 by means of a sealing ring 94. The adjusting piston 89 has a means defining an opening 95 in its longitudinal axis which narrowly surrounds the pump piston 65. A blind bore 96 is drilled into the adjusting piston 89 from below between the pump piston 65 and the adjusting cylinder 87. A transverse bore 97 which connects the blind bore 96 with the opening 95 discharges at the upper end of the blind bore 96. The transverse bore 97 forms a controlled recess. A further transverse bore 98 is disposed below the transverse bore 97. The adjusting piston 89 is sealed off relative to the adjusting cylinder 87 by means of a sealing ring 99. A restoring spring 100 is incorporated between the adjusting piston 89 and the closure plug 92. The adjusting cylinder 87, the adjusting piston 89 with its transverse bore 98 and the spring 100 together make up the adjusting device 69 for the instant of injection. The adjusting piston 89 is acted upon by fuel, which is directed via a connection opening 101 into the housing 63 and is fed along a conduit 102 cut into the circumference of the cylinder 64 toward the adjusting piston 87. The higher the pressure, the farther the adjusting piston 89 is raised counter to the force of the restoring spring 100. The level of the pressure is selected in accordance with the rpm of an internal combustion engine, for instance, for which the injection pump 62 is intended. In order to generate this pressure, a pump and a pressure regulating valve such as are described in U.S. Pat. No. 2,312,264 are used. The pressure regulating valve may be disposed between this pump and the connection opening 101. However, it is also possible to connect the pressure valve to a further connection opening 103, which is drilled into the housing 63 opposite the connection opening 101. In that case, the pump cylinder 64 has a further conduit 104 opposite the conduit 102. Fuel then flows continuously past, along the pump cylinder 64 and underneath the adjusting piston 89, and cools the injection pump 62.

The fuel quantity adjusting device 68 has a rack 105 intersecting the axis of the pump piston 65 at some distance, a toothed segment 106 and a hub 107, which connects the toothed segment 106 in a rotationally fixed manner with the upper end 108 of the pump piston 65. The rack 105 is adjusted in a known manner and thereby rotates the pump piston 65. The pump piston 65 has a groove-like control recess 109, which communicates via an opening 110 with a longitudinal bore 111, which extends through the pump piston to its lower end. The rack 105, the toothed segment 106 with the hub 107 and the control recess 109, together with the transverse bore 97, 98 and the adjusting piston 89, make up the injection quantity adjusting device 68. Thus the adjusting piston 89 simultaneously acts as a control sleeve which surrounds and engages the pump piston 65. Depending on the rotary position of the pump piston 65, this piston travels a variously long distance on its downward stroke, when it is pressed downward in a manner known per se by a cam (not shown) with the drive push rod 66 being interposed, until the control recess 109, after having passed the cross section of the transverse bore 97, comes into congruence with the transverse bore 98. The particular distance traveled, multiplied with the cross section of the pump piston 65, produces approximately that fuel quantity which is pumped at injection pressure. As soon as the control recess 109 has come into congruence with the transverse bore 98, the pressure inside the pump cylinder 64 drops, and the injection process is terminated. The fuel which is under injection pressure inside the pump cylinder 64 abruptly escapes through the transverse bore 98 and causes an increase in pressure in the chamber 81 by way of the conduits 104, 85 and 84. This increase in pressure accelerates the injection nozzle closing piston 79, supplementing the action of the nozzle closing spring 82. The acceleration is all the more pronounced the narrower a throttle (not shown) is which is disposed following the connection opening 103, and the shorter and the wider the conduits 84, 85 and 104 are. The maximum supplementary acceleration occurs if the connection opening 103 is closed by means of a plug.

After the pump piston 65 has been moved into its lowermost postition by means of a cam, the restoring spring 67, which engages the hub 107 via a spring plate 112, presses the pump piston 65 into its outset position. Fuel is thereby aspirated into the pump cylinder 64, so that a next pumping event can take place with a selectable injection quantity and a selectable instant of injection. The instant of injection is earlier the more the adjusting pistion 89 is pressed counter to the force of the restoring spring 100.

At a level between the sealing ring 99 which is disposed at the circumference of the adjusting piston and a further sealing ring 113 disposed at the outermost circumference and above the sealing ring 99, there is an opening 114 into the adjusting cylinder 87. Extending all the way around the opening 114 is an annular chamber 115, from where a hole 116 extends through the housing 63. The opening 114, the annular chamber 115, and the hole 116 serve to carry away fuel passing therethrough between the adjusting cylinder 87 and the adjusting piston 89 and between the adjusting piston 89 and the pump piston 65.

Figure 3:
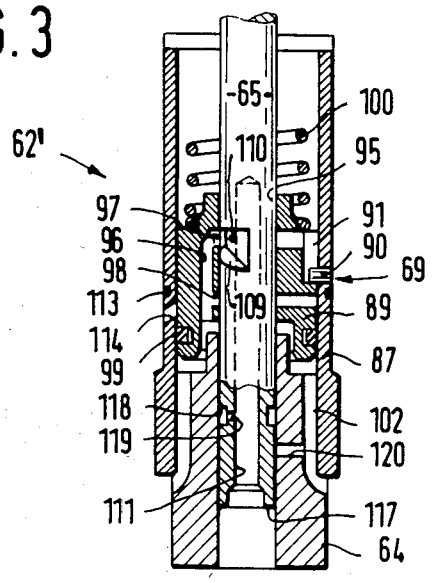
FIG. 3 shows a fragmentary view of a further embodiment of the exemplary embodiment according to FIG. 2.
Figure 4:
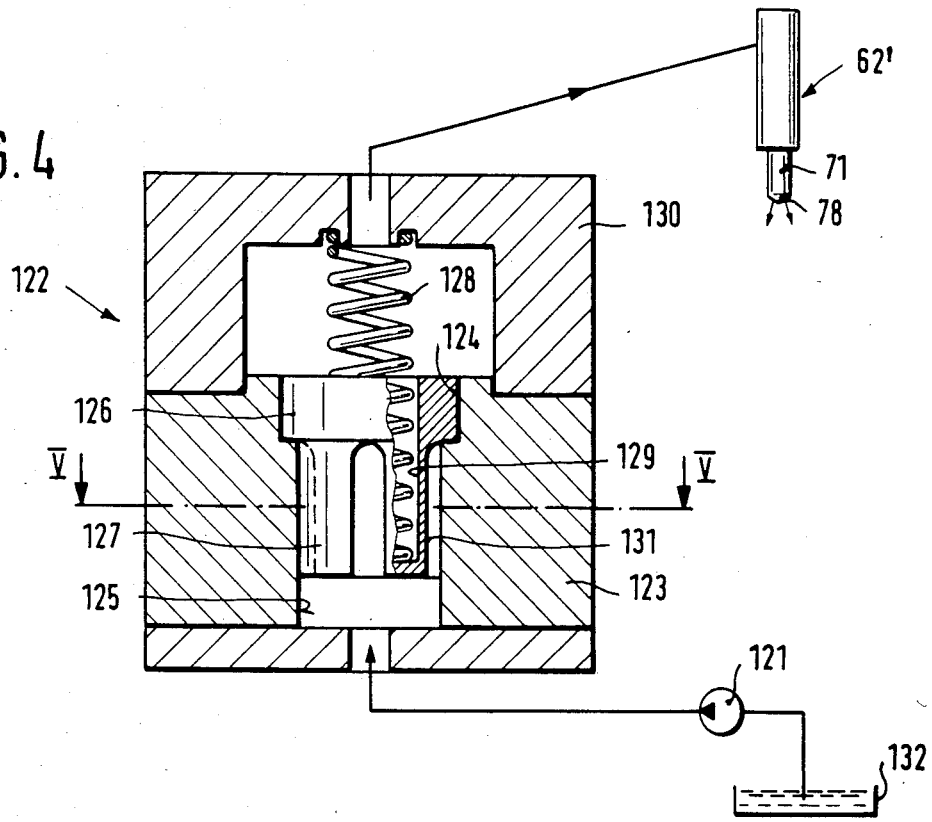
FIG. 4 shows a relief valve for the further embodiment of FIG. 3.
Figure 5:
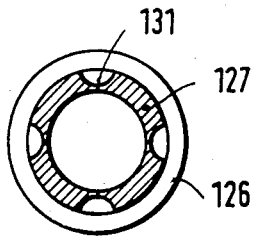
FIG. 5 is a section taken on line V—V of the relief valve of FIG. 4.

In the further embodiment 62′ shown in FIG. 3 of the injection pump 62 shown in FIG. 2, a second control recess 118 which communicates via a bore 119 with a longitudinal bore 111 is disposed between the end 117 of the pump piston 65 oriented toward the valve body 73 and its control recess 109. A transverse bore 120 is associated in the pump cylinder 64 with this second control recess 118. The second control recess 118 and the transverse bore 120 are directed at the pump parts 65, 64 such that they begin to overlap one another whenever the adjusting piston 89, embodied as a control sleeve, is located at least close to its lowermost possible position and thereby strikes against the pump cylinder 64, for instance, and whenever the pump piston 65 is pressed into the pump cylinder 65 out of its uppermost position and the first control recess 109 has therefore for the most part passed the transverse bore 97 directing the onset of injection. As a result, fuel at first escapes through the first control recess 109 and then through the second control recess 118, so that no injection pressure can be built up in the pump cylinder 64. The second control recess 118 and the transverse bore 120 then represent an apparatus, whenever the adjusting piston 89 is not exposed to fuel or is exposed to fuel only at a neglibly small pressure, for preventing an unintentional starting of engine in the event that some external means might have the capacity to start the engine. An example of a case of this kind which is to be prevented is a motor vehicle parked on a hill, in gear but insufficiently braked, where it might be possible for the engine to start. The reduction of the pressure may be effected by example by shutting off a known, electrically driven fuel pump 121. A one-way valve 122 as shown in FIG. 4 is incorporated between this fuel pump 121 and the injection pump 62′. The one-way valve 122 has a cylindrical valve seat 124 in a housing part 123 and a coaxially directed valve shaft guide bore 125, a cylindrical valve body 126 with a valve guidance shaft 127 molded thereon, and a closing spring 128. The diameter of the valve body 126 is selected such that the valve body 126 can be pushed into the valve seat 124 and thus, like a piston, block the passage of fuel through the valve seal 124. The valve shaft guide bore 125 and the valve guide shaft 127 guide the valve body 126 until such time as it moves into the valve seat 124. The closing spring 128 presses into a depression 129, which extends through the valve body 126 and into the valve guide shaft 127 and is thereby supported in a second housing part 130, which is clamped against the housing part 123.

In the longitudinal direction of the valve guide shaft 127, grooves 131 are disposed on its circumference, beginning at its free end and terminating at the valve body 126. The housing part 123 is connected to the fuel pump 121, and the housing part 130 is connected with the injection pump 62′. When operation begins, the fuel pump 121 aspirates fuel from a fuel tank 132 and presses against the valve guide shaft 127 and the valve body 126, so that they are displaced counter to the force of the closing spring 128. As soon as the valve body 126 leaves the valve seat 124 as a result of the displacement, fuel flows through the valve shaft guide bore 125, the groove 131 and the valve seal 124 into the housing part 130 and from there out to the injection pump 62′ which is thus made operationally ready. Upon the shutoff of the fuel pump 121, as a result of the pressure built up by this pump, fuel flows through the leaks which are located in the fuel pump 121 and back into the tank 132. The valve body 126 stressed by the closing spring 128 dips into the valve seat 124 while the fuel is flowing back to the tank and thereby seals the interior of the housing part 130 from the valve shaft guide bore 125 and thus from the fuel pump 121 as well. As a result, fuel remains in the injection pump 62′ and air is prevented from entering this pump 62′. At the same time, the valve body 126, while it moves inside the valve seat 124 as a result of the force of the closing spring 128 and as a result of the pressure drop, serves to provide for an expansion of the fuel enclosed within the injection pump 62′. As a result of the pressure thus being reduced, the restoring spring 100 is capable of pushing the adjusting pistion 89 toward the pump cylinder 64 into the position in which, in the manner already described, an unintentional starting of an engine is prevented.

It is further noted that the additional control groove 118 in the pump piston 65 and the associated transverse bore 120 in the pump cylinder 64 can also be applied to the exemplary embodiment shown in FIG. 1. In that case, if the adjusting piston 46 is moved by means of fuel pressure, the previously described valve 122 can again be disposed between the injection pump 2 and a fuel pump. The disposition of the supplementary control groove in the pump piston and the transverse bore is also possible, however, in injection pumps the control sleeves of which are adjusted mechanically or electrically.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A housed fuel injection pump for Diesel engines having a pump cylinder, a pump piston in said cylinder, said pump piston having at least one control recess, said pump piston being reciprocated by a cam means and a spring means and being rotatable for adjusting an injection quantity, a control sleeve secured against rotation and arranged to cooperate with said control recess for varying the injection quantity, said pump including a hydraulic adjusting means for varying the instant of injection, said hydraulic adjusting means being disposed in a pressure chamber, said pressure chamber comprises an adjusting cylinder which is disposed parallel to said pump cylinder and said hydraulic adjusting means further includes an adjusting piston, said adjusting piston and said adjusting cylinder are accommodated inside said housing of said injection pump, and further said control sleeve and said adjusting piston encircle said pump piston and comprise a one-piece structural component and are adjustable longitudinally of said pump piston.

2. An injection pump as defined by claim 1, characterized in that said adjusting piston further includes a face which is directed toward said pump cylinder, and further that said adjusting cylinder in cooperation with said adjusting piston provides a chamber and further wherein said control sleeve includes at least one means defining an opening therein.

3. An injection pump as defined in claim 2, characterized in that said housing further includes a connection opening for delivery of fuel through said housing to said adjusting cylinder, and that a further connection opening leads outward from the housing, beginning at said adjusting cylinder.

4. An injection pump as defined by claim 3, characterized in that the pressure exerted upon said adjusting piston is regulated by means of the controlled discharge of fuel from said further connection opening.

5. An injection pump as defined by claim 2, characterized in that said adjusting cylinder and said adjusting piston control fuel flow via interconnected conduits to a cylinder which is disposed in proximity to said nozzle, said nozzle further including a displaceable closure piston stressed by a spring and further wherein said adjusting cylinder increases the closing force of said injection nozzle closure piston.

6. An injection pump as defined in claim 1, characterized in that said injection pump is united with an injection nozzle to provide as a structural unit a unit fuel injector, and further that a plurality of injection pumps are connected in common to a means of pressure supply.

7. An injection pump as defined by claim 1, characterized in that said pump piston further includes a second control recess disposed in the pump piston within a zone which remains within the pump cylinder during injection operation, the second control recess being connected by way of a bore and a longitudinal bore in said pump piston to said at lease one control recess in said pump piston and further that said pump cylinder is provided with a transverse bore which is alignable with said second control recess during a pumping stroke, whereby upon said pumping stroke of said pump piston said second control recess and said transverse bore begin to overlap one another whenever said control sleeve is shifted, beginning at the settings for "maximum quantity" and "early instant of injection" are shifted beyond the settings for "late instant of injection".

8. An injection pump as defined by claim 7, characterized in that said pump further includes a one-way valve which opens under pressure in the direction from a fuel supply to said injection pump and is inserted between said injection pump and a fuel pump which provides said fuel supply, and further that this one-way valve has a sealing valve body which is capable of moving upon closure into a cylindrical valve seat and further that said valve body after moving into the valve seat separates the fuel in the injection pump from said fuel supply and upon further displacement enables a pressure-reducing volumetric expansion on the part of the fuel which is located in the injection pump.

* * * * *